US005408716A

United States Patent [19]

Dausch et al.

[11] Patent Number: 5,408,716

[45] Date of Patent: Apr. 25, 1995

[54] FLUID-HANDLING MACHINE INCORPORATING A CLOSED LOOP SYSTEM FOR CONTROLLING LIQUID LOAD

[75] Inventors: Mark E. Dausch, Latham; Vivek V. Badami, Schenectady; Walter Whipple, III, Amsterdam, all of N.Y.

[73] Assignee: General Electric Company, Schenectady, N.Y.

[21] Appl. No.: 185,087

[22] Filed: Jan. 24, 1994

Related U.S. Application Data

[60] Division of Ser. No. 126,139, Sep. 23, 1993, Pat. No. 5,313,964, which is a continuation of Ser. No. 877,300, May 1, 1992, abandoned.

[51] Int. Cl.[6] ..... A47L 15/46; D06F 33/02

[52] U.S. Cl. ..... 8/158

[58] Field of Search ..... 68/12.02, 12.19, 207; 134/57 D, 57 R, 18, 25.2; 137/386, 387; 8/158

[56] References Cited

U.S. PATENT DOCUMENTS

| | | | |
|---|---|---|---|
| 3,359,766 | 12/1967 | Haas | 68/12.19 X |
| 3,478,373 | 11/1969 | McBride et al. | 68/12.19 X |
| 3,508,287 | 4/1970 | Mason | 68/207 X |
| 4,097,307 | 6/1978 | Geiger | 134/57 D X |
| 4,481,786 | 11/1984 | Bashark . | |
| 4,697,293 | 10/1987 | Knoop | 68/12.19 X |
| 4,741,357 | 5/1988 | Battel et al. | 137/387 |
| 4,835,991 | 6/1989 | Knoop et al. | 68/12.19 |
| 4,950,969 | 8/1990 | Getz . | |
| 5,161,110 | 11/1992 | Dorchak . | |

FOREIGN PATENT DOCUMENTS

| | | | |
|---|---|---|---|
| 2577788 | 2/1985 | France . | |
| 3803006 | 8/1989 | Germany | 134/57 D |
| 61185298 | 2/1985 | Japan . | |
| 01146579 | 12/1987 | Japan . | |
| 1274797 | 11/1989 | Japan . | |
| 2077296 | 3/1990 | Japan | 68/12.02 |
| 2079291 | 3/1990 | Japan | 68/12.19 |

OTHER PUBLICATIONS

"Home Appliances", Chapter 16 of *Sensors: A Comprehensive Survey*, vol. 1, edited by W. Gopel, J. Hesse, and J. N. Zemel (1989).

"Invisible at Home, Fuzzy Logic Crosses the Pacific and Bursts Out All Over", published by Computergram International on Feb. 5, 1991.

"WCI Differentiates its Brands: Presents Restyled Lines Aimed at Specific Retail Channels: WCI Appliance Group", published by the Weekly Home Furnishings Newspaper on Feb. 4, 1991.

"The future of electronics Looks 'Fuzzy'", published in The Washington Post on Dec. 23, 1990.

"Fuzzy Logic" published in Popular Science in Jul. 1990.

*Primary Examiner*—Philip R. Coe

*Attorney, Agent, or Firm*—Marvin Snyder

[57] ABSTRACT

A fluid-handling machine, such as a dishwasher or clothes washer, measures liquid load by detecting liquid pressure oscillations. The machine, which includes both a frame for containing articles and a system for circulating or distributing a liquid in the frame, shuts off flow of liquid provided to the frame when the detected liquid pressure oscillations substantially cease, as determined in accordance with a fuzzy logic control strategy.

11 Claims, 3 Drawing Sheets

FLUID-HANDLING MACHINE INCORPORATING A CLOSED LOOP SYSTEM FOR CONTROLLING LIQUID LOAD

This application is a division of application Ser. No. 08/126,139, filed Sep. 23, 1993, now U.S. Pat. No. 5,313,964 issued May 24, 1994, which is a continuation of application Ser. No. 07/877,300, filed May 1, 1992, now abandoned.

RELATED APPLICATIONS

This application is related to patent application Ser. No. 07/877,310, entitled "Sensor Holder for a Machine for Cleansing Articles" by Dausch et al., filed May 1, 1992, now U.S. Pat. No. 5,259,219, issued Nov. 9, 1993; patent application Ser. No. 07/877,310, entitled "Machine for Cleansing Articles," by Molnar et al., filed May 1, 1992, now U.S. Pat. No. 5,291,626, issued Mar. 8, 1994; patent application Ser. No. 07/877,304, entitled "Fluid-Handling Machine Incorporating a Closed Loop System for Controlling Machine Load," by Whipple, III et al., filed May 1, 1992; patent application Ser. No. 07/877,301, entitled "A Fuzzy Logic Control Method for Reducing Water Consumption in a Machine for Washing Articles," by Badami et al., filed May 1, 1992, now U.S. Pat. No. 5,284,523, issued Feb. 8, 1994; patent application Ser. No. 07/877,302, entitled "A Fuzzy Logic Control Method for Reducing Energy Consumption in a Machine for Washing Articles," by Dausch et al., now abandoned, and patent application Ser. No. 07/877,305, entitled "Device for Monitoring Load," by Whipple, III, filed May 1, 1992, abandoned in favor of patent application Ser. No. 08/132,772, filed Oct. 6, 1993, now U.S. Pat. No. 5,319,304, issued Jun. 7, 1994, of which patent application Ser. No. 08/208,760, filed Mar. 9, 1994 is a divisional. The aforesaid patent applications are assigned to the assignee of the present invention and herein incorporated by reference.

FIELD OF THE INVENTION

The invention relates to a method and apparatus for controlling liquid load in a machine. More particularly, the invention relates to a closed loop system for fluid-handling apparatus providing feedback control.

BACKGROUND OF THE INVENTION

Reducing the amount of energy consumption by a fluid-handling machine for cleansing articles in a liquid, such as a clothes washer, is a significant problem, in part because of increasing worldwide energy demand. In such a machine, the amount of energy consumed is primarily determined by the amount of energy needed to heat the liquid, such as water, used to cleanse the articles. Thus, decreased liquid consumption for such machines can result in a significant improvement in energy efficiency.

Appliances, such clothes washers, typically receive liquid for a predetermined duration through a conduit connected to the machine. A wash cycle for such a machine may comprise providing substantially particle-free liquid to the machine, circulating or distributing the liquid during the wash cycle, and draining or flushing the liquid from the machine after being used to wash the articles. Typically, a machine user has limited control over the amount of liquid provided for a wash cycle, such as by selection from a few predetermined options. Such a machine does not use liquid efficiently because variations in liquid pressure or degradation in machine components generally require providing liquid for an excessive duration to ensure more than a sufficient amount for a wash cycle. Closed loop feedback control is one method to improve water conservation in clothes washers. Several devices are available to monitor or measure the amount or volume of liquid provided for a wash cycle.

Devices for measuring the amount of liquid, such as water, include flowmeters that measure the water flow rate to the clothes washer and water level sensors that detect the static air pressure in an air cavity in the sensor. However, such devices may be difficult or non-economic to implement, may be unreliable, may degrade over time, and may not provide robust measurements relative to the machines incorporating them. Furthermore, the accuracy of such devices is not entirely satisfactory due to variations in the amount of liquid needed to satisfactorily cleanse varying amounts of soiled articles.

A need thus exists for a machine for cleansing articles incorporating a closed loop feedback system for monitoring and controlling the amount of liquid provided for a wash cycle.

SUMMARY OF THE INVENTION

One object of the invention is to provide a closed loop feedback control system incorporating a liquid load measuring device and a machine including such a system.

Another object is to provide a liquid load measuring device capable of being used in a fuzzy logic feedback control system providing either periodic or continuous closed loop feedback control, and a machine including such a device and fuzzy logic feedback control system.

An additional object is to provide a liquid load measuring device and closed loop feedback control system that is both more accurate and more reliable than those currently available, and a machine that includes such a system.

In accordance with the invention, a machine, such as a dishwasher or clothes washer, incorporates a device for measuring liquid load that includes a sensor for detecting liquid pressure surges. The machine may further include a frame for containing articles, a system for circulating or distributing a liquid in the frame, and a controller, responsive to the device, for controlling the amount of liquid provided to the frame.

BRIEF DESCRIPTION OF THE DRAWINGS

The subject matter regarded as the invention is particularly pointed out and distinctly claimed in the concluding portion of the specification. The invention, however, both as to organization and method of operation, together with further objects and advantages thereof, may best be understood by reference to the following detailed description when read with the accompanying drawings in which:

DETAILED DESCRIPTION OF THE INVENTION

Figure 1:
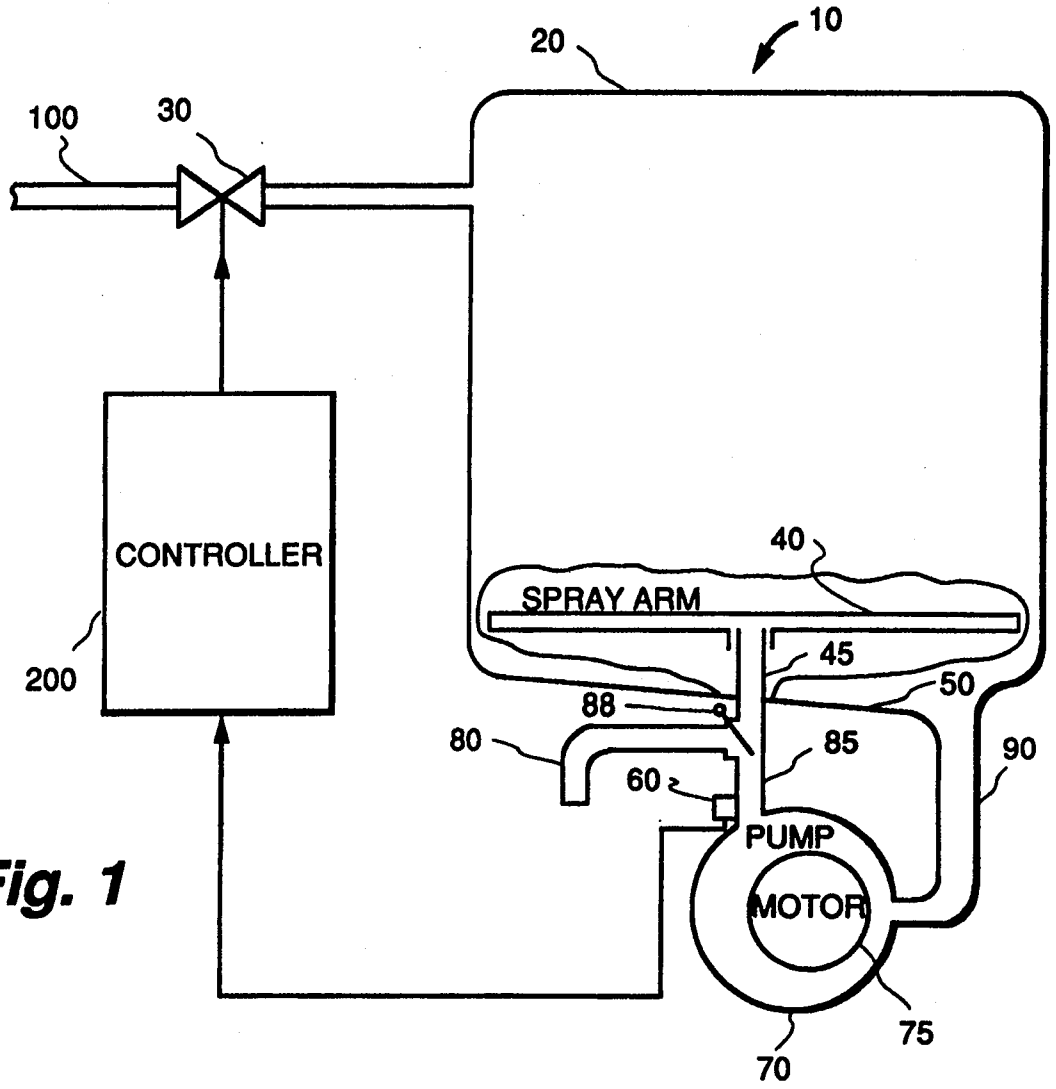
FIG. 1 is a schematic diagram of a machine incorporating a closed loop system for controlling liquid load in accordance with the invention.

FIG. 1 illustrates a machine 10, which comprises, in combination, a frame 20 for containing articles, a system for providing liquid to frame 20, such as a conduit 100 connected to frame 20 through an aperture in the frame, a pump 70, driveably coupled to a motor 75, for circulating or distributing liquid in the frame, a device 60 for monitoring or measuring liquid load as frame 20 receives liquid, and a controller 200 responsive to device 60, for controlling a valve 30 in conduit 100.

The specific configuration of a machine, such as machine 10 for cleansing articles, depends in part on the type of machine employed. For example, as illustrated in FIG. 1, machine 10 comprises a dishwasher and includes: a subsystem to distribute or circulate liquid, which may include a sump 50 of frame 20, a spray arm 40 rotatably connected to, and in liquid communication with pump 70, a pump inlet 90 connecting frame 20 to pump 70, a pump outlet 85, and the pump; a subsystem to provide substantially particle-free liquid, which may include conduit 100 connected to frame 20 through an aperture in the frame, and valve 30 incorporated in conduit 100; and a subsystem to remove liquid, which may include sump 50, pump 70 and an outlet 80. Spray arm 40 includes a spray arm feed 45. As indicated, pump 70 is driven by apparatus, such as motor 75. Valve 88 is a standard valve that may be actuated to direct the flow of liquid into spray arm 40, or, alternatively, outlet 80. Although FIG. 1 illustrates an embodiment of the invention in which a liquid, such as water, is distributed in a machine for cleansing articles, such as food handling items, the invention is not restricted in scope to this embodiment.

Device 60 for monitoring liquid load is shown in FIG. 1 as providing a signal to controller 200. Depending upon the particular embodiment, device 60 may provide a plurality of signals to controller 200. Device 60 includes a sensor for detecting liquid pressure surges produced in the liquid by the liquid distribution subsystem as frame 20 receives liquid though conduit 100. As indicated in FIG. 1, pump 70 distributes or circulates liquid in frame 20. For the embodiment of the invention illustrated in FIG. 1, liquid load refers to the amount of liquid being circulated or distributed in machine 10 during a wash cycle. Liquid load is defined relative to a sufficient amount of liquid for a particular wash cycle; however, in a given situation the liquid load may exceed this sufficient amount or it may be less than this sufficient amount. In the context of the invention, liquid pressure surges refer to substantial changes in liquid pressure when liquid load is changing.

Device 60 may include any one of a number possible sensors for detecting liquid pressure surges in the liquid. Liquid pressure surges occur because as frame 20 receives water through conduit 100 cavitation occurs in the liquid. Cavitation of the liquid refers to partial vacuums, or pockets of a gas, such as air, formed in the liquid, such as water. In the embodiment illustrated in FIG. 1, cavitation of the liquid originates from the action of pump 70 as conduit 100 provides liquid to frame 20; however, in the context of the invention, cavitation in a liquid, such as water, may be the result of any moving solid body in contact with the liquid. Pump 70 operates as liquid is provided to frame 20 and pumps the liquid to spray arm 40 for circulation or distribution. However, the amount of liquid provided to the frame is initially insufficient to fill sump 50, pump inlet 90, pump outlet 85, spray arm 40 including spray arm feed 45, and all of any other portions of a subsystem for circulating or distributing the liquid. Thus, in the embodiment illustrated in FIG. 1, after pump 70 has pumped substantially all of the liquid provided to frame 20, air enters the liquid distribution subsystem. This air produces cavitation in the liquid as it circulates or is distributed in the machine. This cavitation, in turn, produces pressure oscillations or surges in the liquid pressure because the pump imparts substantially no pressure to the liquid when air enters the liquid distribution subsystem.

Figure 3:
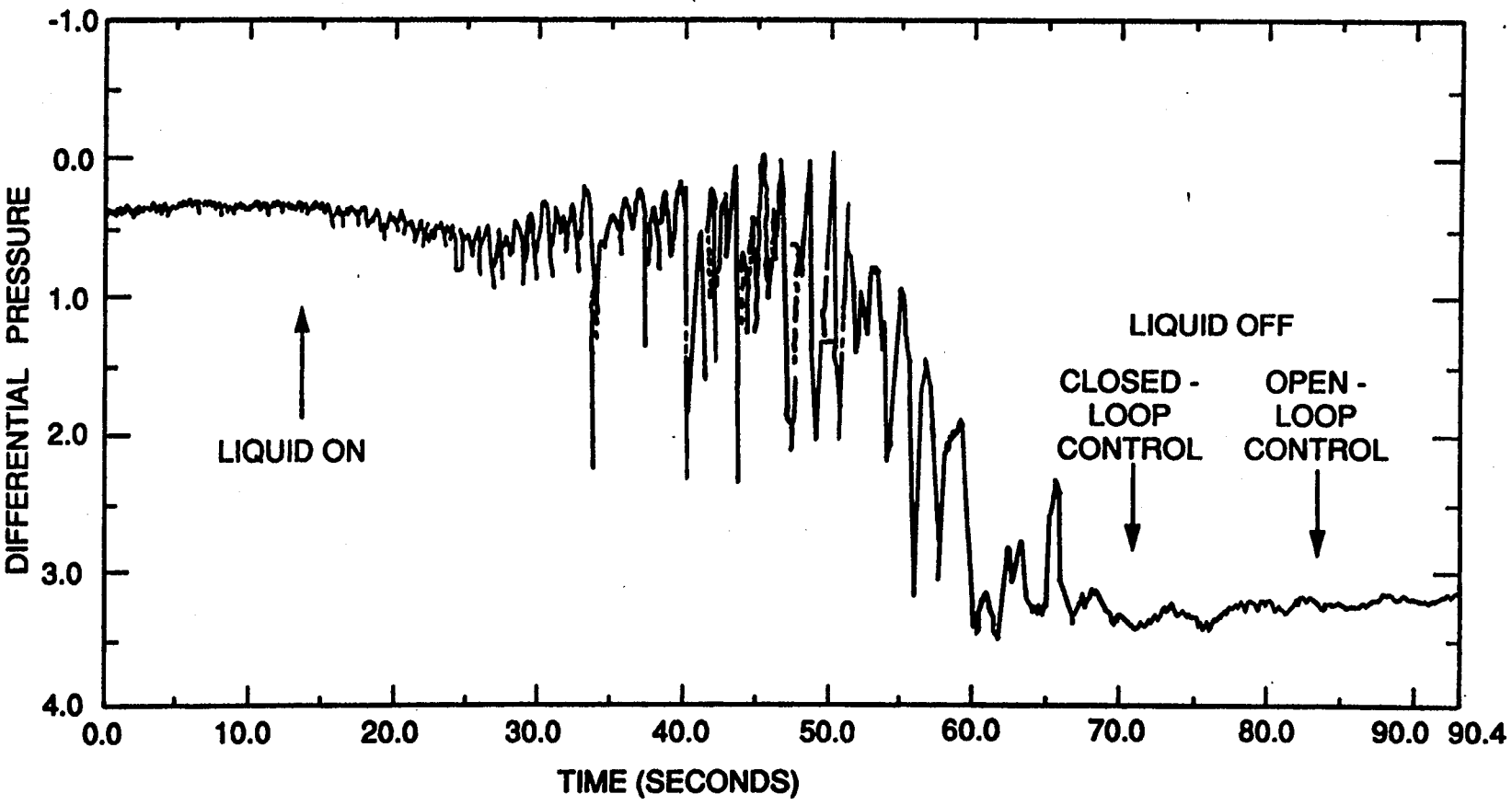
FIG. 3 is a plot of liquid pressure surges versus time for an embodiment of the invention illustrated in FIG. 1.

Cavitation of the liquid indicates that less than a sufficient amount has been received by frame 20 for that wash cycle. Oscillations or surges in the liquid pressure as frame 20 receives liquid and as the liquid is distributed in machine 10 are illustrated in FIG. 3. FIG. 3 is a plot of the output signal of one embodiment of device 60 in a closed loop system for controlling liquid load in accordance with the invention. As frame 20 continues to receive liquid, cavitation of the liquid and, hence, oscillations or surges in the liquid pressure begin to dampen. This occurs because gradually machine 10 receives an amount of liquid sufficient for that wash cycle. The number of articles contained in frame 20 may affect when a sufficient amount of liquid has been provided because the articles may absorb or entrap liquid, or liquid may adhere to the articles. Thus, a feedback control system in accordance with the invention has the capability to accommodate for the number of articles contained in the frame for a specific wash cycle. Likewise, a feedback control system in accordance with the invention accommodates for aging of the machine components, such as pump 70. Eventually, when a sufficient amount of liquid has been received by frame 20 for that wash cycle, cavitation of the liquid substantially diminishes or ceases. This occurs because pump 70 eventually receives a sufficient amount of liquid to pump liquid in a continuous stream. Likewise, oscillations or surges in the liquid pressure substantially dampen out or cease, as depicted in FIG. 3.

A machine incorporating a closed loop system for controlling liquid load, unlike a machine incorporating a closed loop system for controlling machine load, as disclosed in aforesaid patent application Ser. No. 07/877,304, monitors a type of physical phenomenon directly associated with cavitation of the liquid, i.e., oscillations or fluctuations in the volume or mass flow rate of the liquid. In contrast, a closed loop system for controlling machine load monitors a side effect of that physical phenomenon, namely power consumption surges in motor 75, such as monitored by detecting various electrical signals associated with motor 75.

FIG. 1 illustrates controller 200 receiving a signal input and providing a signal output. Depending upon the particular embodiment of the invention, controller 200 may receive a plurality of signal inputs and/or provide a plurality of signal outputs. A signal input to controller 200 is a liquid pressure surge measurement provided by device 60 as frame 20 receives liquid and as the liquid distribution subsystem distributes the liquid. In particular, signals providing measurements for detecting liquid pressure surges correlated with cavitation of the liquid, as previously described, include measurements of the liquid pressure or the liquid volume or mass flow rate taken in the liquid circulation or distribution subsystem, such as in spray arm feed 45, pump 70, pump inlet 90, or pump outlet 85. A number of other signals from machine 10, such as signals conveying information about progress of a washing or cleansing or of a particular wash cycle, may also be provided to controller 200. Furthermore, a number of signal inputs may be provided by controller 200 to machine 10 for feedback control. Signal outputs provided by controller 200 include signals to machine 10 for controlling valve 30 to open and close conduit 100. It will be understood that based upon other signals provided by controller 200, such as disclosed and described in aforesaid U.S. Pat. No. 5,291,626, or alternatively based upon selections by the machine user, the number of wash cycles and the duration of those wash cycles may vary for a particular washing.

A number of possible embodiments exist for controller 200 and the invention is not limited to any particular embodiment. For example, controller 200 may comprise a closed loop feedback control system including a microprocessor, a microcontroller, an application specific integrated circuit (ASIC), a digital signal processor (DSP), or other processor. The microprocessor may incorporate a linear or non-linear closed loop feedback control algorithm. For example, the microprocessor or other processor may be programmed to implement a physically realizable frequency domain or time domain representation of a transfer function for a control system for a machine, such as a machine for cleansing articles. Alternatively, the closed loop feedback control system may comprise a microprocessor or other processor incorporating a fuzzy logic feedback control algorithm, such as disclosed in aforesaid U.S. Pat. No. 5,284,523. The fuzzy logic feedback control algorithm, or any other appropriate linear or non-linear closed loop feedback control algorithm may control the opening and closing of conduit 100. At the beginning of a wash cycle, frame 20 receives liquid by opening conduit 100. In the context of this invention, the opening and closing of conduit 100 or, alternatively, the duration for which liquid is provided to frame 20, defines the beginning of a wash cycle. A wash cycle comprises providing substantially particle-free liquid to the frame, circulating the liquid during the wash cycle, and draining or flushing the liquid from the frame after being used to wash the articles. A complete washing comprises washing or cleansing the articles in one or more wash cycles until the articles are substantially free of particles. Nonetheless, a wash cycle may have other significant aspects, such as rinsing the articles, providing agents to clean, enhance cleaning, or assist in rinsing the articles, monitoring and adjusting the temperature of the liquid, or other aspects. Likewise, a wash cycle may include draining only a portion of the liquid used to wash the articles or providing only a portion of the substantially particle-free liquid sufficient for a wash cycle. Thus, depending upon the signals from controller 200, conduit 100 may be opened for a duration to provide only a portion of the sufficient amount of liquid. The former characterization of a wash cycle is not intended to exclude the latter aspects of a wash cycle.

A closed loop feedback control algorithm, such as the fuzzy logic feedback control algorithm disclosed in aforesaid U.S. Pat. No. 5,284,523, may provide periodic, or discrete-time, closed loop feedback control for the system for washing or cleansing articles or it may provide continuous closed loop feedback control. In periodic feedback control, the closed loop feedback control system may incorporate, in real-time, sequences of measurements, such as several measurements per second, provided by the device for monitoring liquid load. The closed loop feedback control algorithm uses the measurements to make determinations regarding the amount of liquid to provide to frame 20 or to determine when a sufficient amount has been provided. In contrast, the closed loop feedback control algorithm may provide continuous closed loop feedback control of liquid load, such as for a machine for cleansing articles. Using a closed loop feedback control algorithm providing continuous closed loop feedback control, during a wash cycle the controller continuously receives signals during the wash cycle and based upon that information determines the appropriate point in time to open and close conduit 100 to provide a sufficient amount of liquid for that wash cycle.

In an alternative embodiment, controller 200 may comprise a closed loop feedback control system including electronic circuitry for determining when liquid pressure surges, and hence cavitation, has substantially damped out or ceased. The electronic circuitry may incorporate analog electronic circuit components, digital electronic circuit components, or both. It will be appreciated by those skilled in the art that a multitude of possible electronic circuits may be designed and constructed to implement a multitude of possible closed loop feedback control systems. For example, an electric circuit may be a physical realization of a frequency domain representation of a transfer function for a control system for a fluid-handling machine. A host of factors, including the particular type of machine, will affect the determination of the particular transfer function to be realized by the electronic circuitry used to implement it.

In a machine for cleansing articles, such as a dishwasher or clothes washer, controller 200 may comprise a closed loop feedback control system to control the washing or cleansing of articles in accordance with any turbidity measurements obtained, as disclosed in aforesaid U.S. Pat. No. 5,291,626, any power consumption surges detected, as disclosed in aforesaid patent application Ser. No. 07/877,304, any liquid pressure surges detected, or any combination thereof. Any of the previously described embodiments of a closed loop feedback control system may accomplish this, including a microprocessor or other processor incorporating a closed loop feedback control algorithm, such as the fuzzy logic feedback control algorithms disclosed in aforesaid patent application Ser. No. 07/877,302, and U.S. Pat. No. 5,284,523.

As described, a fuzzy logic controller may be used to control the amount of water to be provided to a machine for washing articles. One may determine when the machine has sufficient water by sensing the end of oscillations or surges in the motor. Several methods for sensing when the motor has ceased to surge are by measuring the pump motor current, pump motor current/voltage phase angle difference, motor speed, power and water pressure. Thus, a signal is available for determining when the pump motor has ceased to surge. In a method for using the features of this signal, the amplitude of oscillation and slope of the average signal is used to determine the end of motor surge. A third variable, elapsed time, is also used to ensure that the water is not shut off prematurely due to system noise very early in the fill operation.

One embodiment of the sensor for detecting liquid pressure surges included in device 60 comprises a sensor that measures the liquid pressure, or changes thereof, in spray arm feed 45, pump inlet 90, pump outlet 85, or pump 70. A device suitable for this purpose includes a liquid pressure sensor that provides an output signal, such as a voltage signal, proportional to the differential liquid pressure between predetermined locations. Likewise, other devices suitable as liquid pressure sensors provide the gage, absolute, or vacuum pressure at a predetermined location. One example of an adequate differential liquid pressure sensor is part number 142PC15D, available from Micro Switch, Inc. (a division of Honeywell), providing a voltage signal varying from 0 to 6 volts. Other liquid pressure sensors available from Micro Switch include part numbers 142PC15G (gage pressure), 142PC15A (absolute pressure), and 141PC15G (vacuum pressure). Nonetheless, almost any liquid pressure sensor, as described above, would prove suitable in the context of the invention. An embodiment of the invention including a liquid pressure sensor is illustrated in FIG. 1.

Figure 2:
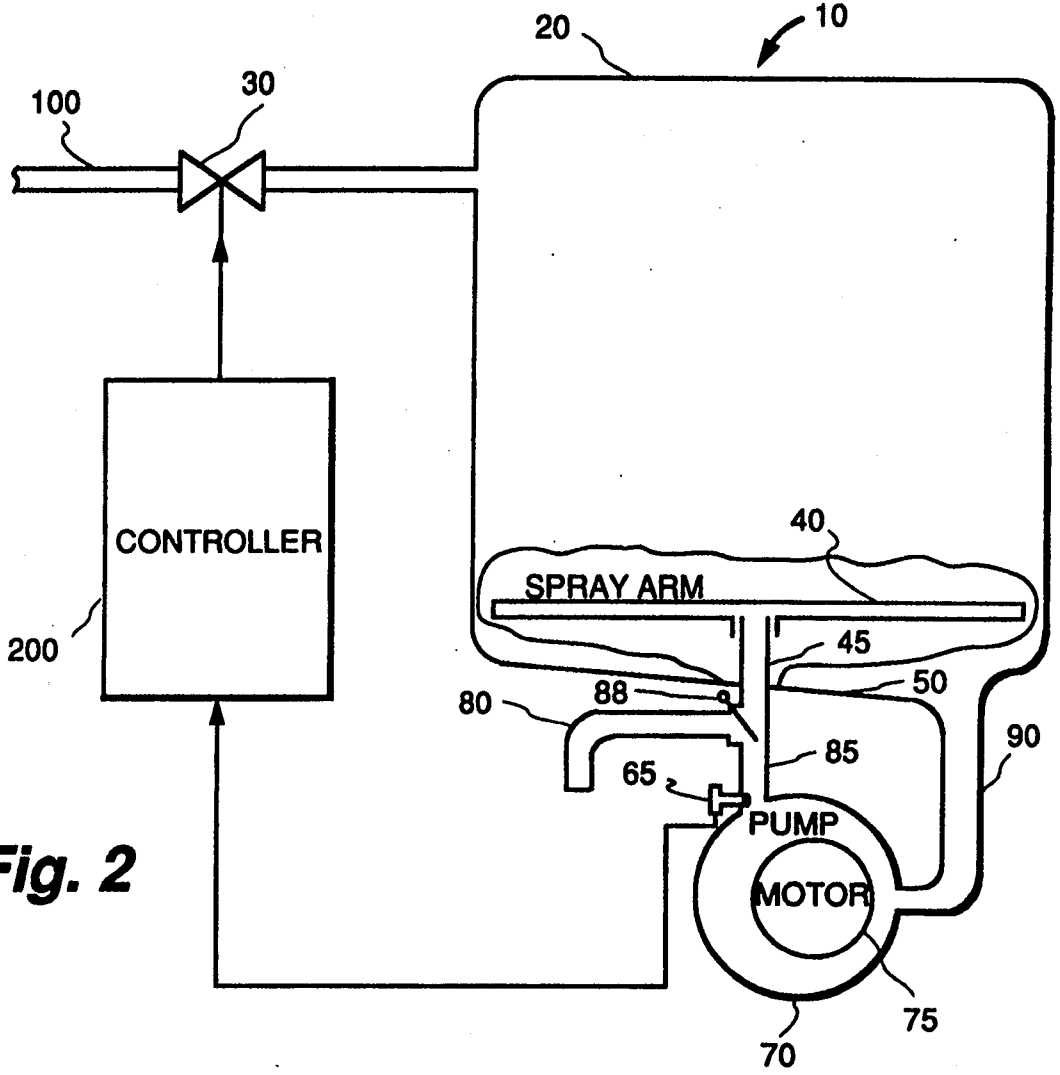
FIG. 2 is a schematic diagram of an alternative embodiment of a machine incorporating a closed loop system for controlling liquid load in accordance with the invention.

An alternative embodiment of the invention employing a sensor for detecting liquid pressure surges utilizes a sensor 65 that measures the liquid volume or mass flow rate, or changes thereof, in spray arm feed 45, pump inlet 90, pump outlet 85, or pump 70. Such a sensor may provide an output signal, such as a current signal, proportional to the liquid volume or mass flow rate at a predetermined location. One example of such a sensor is part number 0602074, available from TDI, Inc., providing a current signal varying from 4 to 20 milliamperes, depending upon the flow rate. Again, almost any liquid volume or mass flow rate sensor would provide adequate performance in the context of the invention. An alternative embodiment of the invention including such a sensor is illustrated in FIG. 2.

A sensor for detecting liquid pressure surges may comprise other embodiments and the invention is not restricted to any particular embodiment. By sensing when oscillations or surges in the liquid pressure substantially dampen or cease, the appropriate time to no longer provide liquid, such as by closing conduit 100, may be determined to ensure that a sufficient, but not excessive, amount of liquid for the wash cycle has been provided.

An additional feature of a machine incorporating a closed loop system for controlling liquid load in accordance with the present invention includes the capability to store information regarding previous wash cycles. For example, in a machine for cleansing articles, such as a dishwasher, this information may be used by the closed loop feedback control system to make future determinations regarding the amount of liquid to provide to the machine for a wash cycle. This information may be used to take into account factors such as the aging of machine components, deterioration of the sensor for detecting liquid pressure surges, and other factors.

A machine incorporating a closed loop system for controlling liquid load in accordance with the present invention may be operated according to the following method. A liquid, such as water, may be provided to machine 10 illustrated in FIG. 1 through conduit 100. As machine 10 continues to receive liquid, the liquid is circulated or distributed by the liquid circulation or distribution subsystem, such as by spray arm 40 connected to pump 70. Liquid pressure surges are detected as machine 10 receives liquid through conduit 100 and as liquid is distributed in machine 10 by the liquid distribution subsystem. The amount of liquid provided to machine 10 is controlled in accordance with the detected liquid pressure surges. In particular, the amount of liquid provided to the machine is controlled so that the liquid pressure surges substantially dampen out or cease, as previously described. Once the liquid pressure surges have substantially dampened or ceased, liquid is no longer provided to machine 10. For example, conduit 100 is closed, in one embodiment, by deenergizing a solenoid for actuating valve 30, shown in FIG. 1. In this embodiment, valve 30 is normally in a position to close conduit 100 so that the conduit closes when the solenoid is no longer actuated.

Controller 200 controls the amount of liquid provided to machine 10. For example, in an embodiment of the invention in which controller 200 comprises a microprocessor or other processor incorporating a fuzzy logic feedback control algorithm, such as disclosed in aforesaid U.S. Pat. No. 5,284,523, the fuzzy logic feedback control algorithm monitors three fuzzy variables: time, amplitude, and slope. The algorithm disclosed in the aforesaid patent application uses these variables to determine the corresponding value of a fuzzy logic control variable. The algorithm then uses a defuzzification method, such as centroid defuzzification, to determine the appropriate time to close conduit 100. Alternatively, a fuzzy logic control algorithm may determine the duration of keeping conduit 100 open to provide a sufficient amount of liquid to machine 10 for the wash cycle. It will be appreciated, however, that the invention is not limited in scope to this particular fuzzy logic feedback control algorithm or to any particular closed loop feedback control algorithm, whether incorporating a fuzzy logic control strategy or a linear or other non-linear control strategy.

In the method described above, detecting liquid pressure surges in an apparatus driving a liquid circulation or distribution subsystem for the machine, comprises several alternative embodiments. In one embodiment, detecting liquid pressure surges comprises measuring the liquid pressure, or any changes thereof, in spray arm feed 45, pump outlet 80, pump inlet 90, or pump 70. In an alternative embodiment, detecting liquid pressure surges comprises measuring volume or mass liquid flow rate, or any changes thereof, in spray arm feed 45, pump outlet 80, pump inlet 90, or pump 70.

While only certain features of the invention have been illustrated and described herein, many modifications, substitutions, changes, and equivalents will now occur to those skilled in the art. For example, a closed loop system for controlling liquid load incorporated in a machine for cleansing articles may be used to control other aspects of a washing or wash cycle. Likewise, a closed loop system for controlling liquid load in accordance with the present invention may be useful in machines other than dishwashers. It is, therefore, to be understood that the appended claims are intended to cover all such modifications and changes as fall within the true spirit of the invention.

What is claimed is:

1. A method for cleansing articles by utilizing a machine including means for distributing liquid in said machine, said method comprising the steps of:

(a) providing said liquid to said machine;

(b) distributing said liquid in said machine as said machine receives said liquid;

(c) detecting liquid pressure oscillations in said liquid as said machine distributes said liquid; and (d) shutting off flow of said liquid provided to said machine when the detected liquid pressure oscillations substantially cease in accordance with a fuzzy logic feedback control strategy based upon:
(i) elapsed time for distributing said liquid;
(ii) an amplitude of the detected liquid pressure oscillations; and
(iii) an average slope of the detected liquid pressure oscillations.

2. The method of claim 1, wherein the step of detecting liquid pressure oscillations comprises the step of measuring the pressure of said liquid.

3. The method of claim 1, wherein the step of detecting liquid pressure oscillations comprises the step of measuring changes in the pressure of said liquid.

4. The method of claim 1, wherein the step of detecting liquid pressure oscillations comprises measuring the flow rate of said liquid.

5. The method of claim 1, wherein the step of detecting liquid pressure oscillations comprises measuring changes in the flow rate of said liquid.

6. A method for cleansing articles by utilizing a machine including means for distributing liquid in said machine, said method comprising the steps of:
(a) providing said liquid to said machine;
(b) distributing said liquid in said machine as said machine receives said liquid;
(c) detecting liquid pressure oscillations in said liquid as said machine distributes said liquid; and
(d) controlling the amount of liquid provided to said machine in accordance with a fuzzy logic feedback control strategy so that the flow of said liquid provided to said machine is shut off when said liquid pressure oscillations substantially dampen out, said fuzzy logic feedback control strategy being based upon:
(i) elapsed time for distributing said liquid;
(ii) an amplitude of the detected liquid pressure oscillations; and
(iii) an average slope of the detected liquid pressure oscillations.

7. The method of claim 6, wherein the step of detecting liquid pressure oscillations comprises the step of measuring the pressure of said liquid.

8. The method of claim 6 wherein the step of detecting liquid pressure oscillations comprises the step of measuring changes in the pressure of said liquid.

9. The method of claim 6, wherein the step of detecting liquid pressure oscillations comprises measuring the flow rate of said liquid.

10. The method of claim 6, wherein the step of detecting liquid pressure surges comprises measuring changes in the flow rate of said liquid.

11. The method of claim 6, wherein the amount of liquid provided to said machine is controlled so that enough liquid is provided to cause said liquid pressure oscillations to substantially dampen out.

* * * * *